US008769889B2

(12) United States Patent
Lenhardt

(10) Patent No.: US 8,769,889 B2
(45) Date of Patent: Jul. 8, 2014

(54) SPACER FOR INSULATING GLASS PANES

(75) Inventor: Karl Lenhardt, Bad Liebenzell (DE)

(73) Assignee: Plus Inventia AG, St. Gallen (CH)

( * ) Notice: Subject to any disclaimer, the term of this patent is extended or adjusted under 35 U.S.C. 154(b) by 0 days.

(21) Appl. No.: 13/201,833

(22) PCT Filed: Feb. 15, 2010

(86) PCT No.: PCT/EP2010/000925
§ 371 (c)(1),
(2), (4) Date: Aug. 16, 2011

(87) PCT Pub. No.: WO2010/094446
PCT Pub. Date: Aug. 26, 2010

(65) Prior Publication Data

US 2011/0296796 A1 Dec. 8, 2011

(30) Foreign Application Priority Data

Feb. 18, 2009 (WO) ..... PCT/EP2009/001155
Apr. 9, 2009 (WO) ..... PCT/EP2009/002649

(51) Int. Cl.
*E06B 7/00* (2006.01)

(52) U.S. Cl.
USPC ..... 52/204.593; 52/786.13

(58) Field of Classification Search
USPC ..... 52/204.593, 204.6, 172, 786.1, 786.13, 52/656.8
See application file for complete search history.

(56) References Cited

U.S. PATENT DOCUMENTS 3,935,683 A * 2/1976 Derner et al. ..... 52/172
4,322,926 A * 4/1982 Wolflingseder et al. ..... 52/172
4,720,950 A * 1/1988 Bayer et al. ..... 52/172
4,994,309 A * 2/1991 Reichert et al. ..... 428/34
5,165,208 A * 11/1992 Lingemann ..... 52/456
6,370,838 B1 * 4/2002 Evason et al. ..... 52/786.13
2006/0037262 A1 * 2/2006 Siebert et al. ..... 52/204.593
2006/0260227 A1 * 11/2006 Winfield ..... 52/204.593
2008/0263973 A1 10/2008 Lenhardt
2009/0291238 A1 11/2009 Scott et al.

FOREIGN PATENT DOCUMENTS

DE 235644 A1 5/1975
DE 2816437 B1 8/1979
DE 8204453.8 U1 7/1982
DE 3434545 C1 7/1985
DE 8809327 U1 11/1988
DE 202 00 349 U1 6/2003
EP 0 139 262 A1 5/1985
EP 0947659 A2 10/1999
EP 1030024 A2 8/2000
GB 2220694 A * 1/1990 ..... E06B 3/68

OTHER PUBLICATIONS

Translation of abstract of Dreiss DE202 00 349 by Espacenet.*

* cited by examiner

*Primary Examiner* — Brian Glessner
*Assistant Examiner* — Brian D Mattei
(74) *Attorney, Agent, or Firm* — Hackler Daghighian & Martino

(57) ABSTRACT

A method for the production of a frame-shaped spacer for insulating glass panes which includes individual glass plates spaced by adhering the spacer to them, including the steps of selecting a metallic hollow profile bar, which includes an outer wall, an inner wall opposite the outer wall and two flanks which are parallel to one another, the inner wall and the outer wall being narrower than the hollow profile bar, and forming the spacer from the hollow profile bar, so that their flanks face the glass plates.

20 Claims, 8 Drawing Sheets

SPACER FOR INSULATING GLASS PANES

Spacers for insulating glass panes consist usually of hollow profile bars of aluminium or stainless steel, which contain a free-flowing desiccant, usually molecular sieves. The desiccant has the function of absorbing humidity in the insulated glass pane, so that the dew point is always exceeded under the prevailing temperatures in the insulating glass pane. Today metal spacers are usually bent in their entirety of a single hollow profile bar which has already been filled with the desiccant. The inner wall is notched before bending a corner, so that the corner forms exactly on the intended location and has a defined appearance. By inner wall is meant the wall of the spacer facing the inside of the insulating glass pane. The wall opposite the inner wall of the hollow profile bar is called its outer wall or base. The two walls, which connect the inner wall and the outer wall and face in the insulating glass pane its individual glass plates, are called flanks; they mostly run predominantly parallel to one another, because they are to be adhered to the glass plates.

After the bending, both ends of the hollow profile bar, which are then opposite to one another, are joined by means of a male connector and a closed frame is hence fowled. The hollow profile bars to be bent are generally connected to one another consecutively by straight male connectors. The spacers may therefore also contain several straight male connectors. Such frame-shaped metal spacers have good mechanical stability. However, there is the disadvantage that their production is expensive.

Also known are spacer frames which are which are made of metallic U-profiles, of thermoplastic solid profiles that are extruded directly onto a glass pane, or of plastic hollow profiles that are filled with a grainy, free-flowing desiccant like spacers made of metallic hollow profile bars.

Spacers made of plastic hollow profiles have only a small thermal conductivity, so that they advantageously slow the heat transfer between the various glass panes of an insulating glass pane. It is however disadvantageous that hollow profile bars of plastic cannot be bent to provide angular frames, if the profile bars have the hardness and sturdiness required for use as spacers in insulating glass panes. This is in particular valid for hollow profile bars made of fibreglass-reinforced plastic. It might be contemplated to form spacer frames made of plastic hollow profiles by connecting straight hollow profiles forming the branches of the frame-shaped spacers with metallic elbows that are inserted into the ends of the hollow profile sections, where they cling with barbs. This technique, which has been known for a long time for the production of metallic spacers, is labour-intensive and leads to spacer frames which are altogether weak due to insufficient stiffness in the corner area and cannot be handled easily and cannot be glued to a glass pane with the required precision. Moreover, spacer frames having such plugged corners are disadvantageous in that insulated glass panes have to be sealed hermetically at their edge against the penetration of moisture.

It is also known to make spacers of metallic hollow profile bars by connecting individual hollow profile bars on the corners of the spacer using elbows which have two branches connected by a mobile joint, which can be locked in a position in which the branches enclose a right angle. For this purpose, the individual hollow profile bars are at first connected to one another along a straight line, provided throughout with an adhesive sealing mass on their flanks and then formed into a frame by pivoting the hollow profile bars around the joint of the respective elbow. This frame is closed by a linear male connector inserted the ends of the hollow profile bar. Such a construction of the corners produces weak spacers with the shortcomings above mentioned.

For producing a spacer with a single plastic hollow profile bar it is known from EP 0 947 659 A2 and EP 1 030 024 A2 to notch hollow profile bars at the locations on which corners are to be formed by cutting V-shaped incisions whose tips reach up to the wall of the hollow profile strip situated outside in the finished spacer. To form a frame then only the outer wall is bent on the notched locations of the hollow profile bar. In this manner spacers can be obtained which have a closed outer wall on the corners but the frame is a weak structure and must be stabilised by additional means because the branches of the spacer are then only joined together via their outer wall. For this reason EP 0 947 659 A2 and EP 1 030 024 A2 suggest to inject a thermoplastic synthetic material into the corner regions of the spacer frame through an opening in one of its flanks. The thermoplastic synthetic material bridges the corners and provides the required stability of the spacer after cooling down and hardening. Disadvantageously, it takes a rather long time for the synthetic material to cool down and harden. To reduce the time necessary for this EP 1 030 024 A2 discloses to transfer the spacer into a particular hardening zone during production, after injection of the synthetic material and by preserving the angle of the bent corner. This mode of operation is time and cost intensive.

A significant improvement in this respect was made by WO 2006/077096 A1, which discloses a spacer for insulating glass panes which is formed from a hollow profile bar of synthetic material by providing it with a recess on the respective locations intended for the corners. The recess which opens the inner wall and both flanks of the hollow profile bar, but leaves the outer wall intact. Elbows are used for stabilising the corners, which elbows have two branches connected through a mobile joint and can be transferred from a rectilinear shape into an angled shape in which they can be locked relative to one another. At first such an elbow is positioned rectilinearly in the area of the respective corner to be formed. The corner is formed by bending the hollow profile bar and stabilised by the branches of the elbow which are locked in their preset angular position. It is also known from WO 2006/007096 A1 to apply an adhesive sealing mass and a compound containing a desiccant on the still rectilinear hollow profile bar, in which the still rectilinear elbows have already been inserted, and then to form the corners in the hollow profile bar and to connect both ends of the hollow profile bar.

SUMMARY OF THE INVENTION

An object of the present invention is to show how an improved frame-shaped spacer with bent corners can be produced for insulating glass panes using metallic hollow profile bars, without increasing the production costs of insulating glass.

This object is met by the use of a metallic hollow profile bar having the features specified in claim 1.

The invention has significant advantages:

- The hollow profile bar according to the invention allows to produce spacers with bent corners, which are sealed hermetically, also on the critical corners of the spacer.
- The new profile shape of the hollow profile bars facilitates the bending of the corners.
- When both flanks of the hollow profile bar, preferably also its inner wall, are indented in the location of the hollow profile bar intended to form the respective corner, before said bar is bent, it can be ensured without further measures that on the one hand the inner wall of the hollow profile bar follows a defined reproducible curve in the region of the corner and that on the other hand both flanks of the hollow profile bar are not pressed outwardly and/or do not generate folds which widen the spacer in the region of a corner during bending. Instead, the excess material of the flanks is forced into the cavity of the hollow profile bar, so that the width of the hollow profile bar does not exceed the original width of the hollow profile bar even in the region of the corners after bending. This is important, since if it were not so, pressure peaks would appear in the region of the corners when the insulating glass panes are pressed on, causing glass breakage. The profile shape of the hollow profile bars according to the invention makes it possible to indent them and to bend them subsequently without risking to damage the spacer.

Hollow profile bars according to the invention enable to bend the corners and to close the spacer manually. The amount of equipment, which until then was necessary for the production of metal spacers for insulating glass panes, can be reduced substantially.

In comparison to spacers of synthetic material, as disclosed in WO 2006/077096 A1, which can also be bent and closed manually, there is an advantage that no corner angle piece is necessary for stabilising the corners obtained by bending and that any machining of the following corner regions of the hollow profile bar required before bending is much easier: There is no need to produce complicated cutouts, there is no need to remove any scrap, there is no need for expensive tools. It is rather only necessary to indent the hollow profile bar before bending at the locations intended for said bending.

As the hollow profile bar need not be notched in the region of the corners, but rather it is sufficient to simply indent it and thus to obtain a continuous hollow profile even in the corners, the corners are sufficiently stable for mounting in an insulating glass pane without any particular stabilising measure.

Since the hollow profile is kept continuous even in the corner region of the spacer, the spacer can form a double barrier and hence a double safety against the penetration of moisture into the insulating glass pane.

Should in isolated cases indenting of the hollow profile bar produces a crack at a given location, this would not prevent it from being mounted in an insulating glass pane, since the outer wall of the spacer, which is particularly important for sealing the inner space of the insulating glass pane, generally does not run the risk of being torn down during the bending process.

Despite folding the flanks of the hollow profile bar by unguided forces, perfect sealing of the insulating glass pane can be achieved by the application of sealing mass even in the critical corner region of the spacer. Any sealing masses known in prior art for bonding and sealing insulating glass panes may be used.

According to the invention, a hollow profile bar is used for the spacer. The inner wall and also the outer wall are narrower than the hollow profile bar, so that its flanks have a middle partial region running parallel to the surface of the opposite glass panes, and have recessed partial regions with respect thereto, adjoining this middle partial region on both sides. The recesses regions each end on the inner wall respectively on the outer wall of the hollow profile bar, which are each narrower than the hollow profile bar as a whole, which has its largest width between the middle partial region of the flanks. A spacer with such a profile can for the purposes of the invention be used in a wide variety of applications. An adhesive compound containing a desiccant can be provided in the recessed partial region, adjoining the inner wall, in a sufficient amount which contains enough desiccant for preventing the insulating glass pane from fogging up from the inside during the planned service life of more than 20 years, preferably of more than 25 years. There is an additional advantage in that there is no need to pour desiccant into the cavity of the hollow profile bar, so that said bar can be bent in empty condition more easily and with less effort.

A primary sealing compound containing no desiccant can be applied in a thin layer to the middle partial region of the flanks. Such a primary sealing compound prevents the inward diffusion of water vapour from the outside just as reliably as the loss of a gas different from air, with which the insulating glass pane can be filled.

A secondary sealing compound can be provided in the recessed partial region of the flanks adjoining the outer wall. The secondary sealing compound sets and produces the durable mechanical bond between the glass panes and the spacer.

But it is also possible to use a primary sealing compound as a base for the sealing compound containing the desiccant, in particular a compound based on polyisobutyles, in which the desiccant is embedded in powder form. The same secondary sealing compound which is provided in the recessed region of the flanks adjoining the outer wall can also be applied to the middle partial region of the flanks instead of a desiccant-free primary sealing compound.

A uniform sealing compound which fulfils the function of a primary sealing compound as well as the function of a secondary sealing compound and contains a desiccant at least in the partial region of the flanks adjoining the inner wall can also be applied to all the three sections of the flanks.

The recessed regions of the flanks not only enable to absorb sufficient amounts of primary or secondary sealing compound but have also the advantage that bendings of the individual glass panes caused by wind loads, temperature loads and fluctuations of the ambient pressure do not cause fissures in the sealing compounds. Fissures can cause leaks in the insulating glass pane. With such bending movements, the narrow middle partial regions of the flanks provide a fixed point for the bending movements, which pull the strongest close to the inner wall and close to the outer wall at the sealing compound present in these locations, but do not induce the formation of cracks in the sealing compound, because said sealing compound is present in such a large thickness, that their tear strength is not exceeded.

Basically, the hollow profile bar may contain a desiccant at the time of bending. In such a case, steps should be taken to ensure that in the corner region of the hollow profile bar there is less desiccant during bending than outside the corner region. It is favourable that desiccant is squeezed out of the corner region by the contour of the walls of the hollow profile bar generated by indenting the hollow profile bar and by the bending process itself. This facilitates the bending process. The hollow profile bar is preferably indented and bent in empty state and preferably no desiccant is poured into the hollow profile bar even thereafter, This has the advantage that the production of the hollow profile bar can be simplified. If the hollow profile bar contains a desiccant, then said desiccant has to be exposed to the airspace in the insulating glass pane once the insulating glass pane has been assembled; the inner wall of the hollow profile bar has to be perforated for that purpose. If however the hollow profile bar is not filled with a desiccant, then the hollow profile bar requires no perforation whatsoever, but can rather be produced cost-efficiently by a simple extrusion process. This concerns first and foremost hollow profile bars made of aluminium. Alternately, the hollow profile bar can are formed from a non-perforated metal band by roll forming; in such a case, it has a longitudinal seam, which is secured advantageously by welding, in particular by laser welding. The production by roll forming concerns first and foremost hollow profile bars made of stainless steel. The longitudinal seam is preferably sealed hermetically by the welding process. The longitudinal seam can also be hermetically sealed by gluing. It is preferable, that the hollow profile bar has no opening whatsoever in any of its walls. This enhances the prevention of the penetration of air humidity into the insulating glass pane, since the walls of the metallic hollow profile bar which do not contain openings are diffusion-tight against water vapour. For sealing the insulating glass pane, only the slots between the flanks of the hollow profile bar and the two glass plates of the insulating glass pane need to be sealed using an adhesive compound, which is prior art. Since the flanks of the hollow profile bar, when using the method according to the invention, are not forced outwardly during bending in the corner area, but rather the excess material is forced inwardly, a sufficient amount of adhesive sealing mass can be applied to the flanks in the corner region which is particularly critical for sealing an insulating glass pane, said compound can then interlock with the folds generated in the corner area and hence lengthen the diffusion path.

The adhesive sealing mass to be applied to the flanks is for instance a thermoplastic polyisobutylene and should prevent the diffusion of humidity through the gap sealed with the sealing mass between spacer and glass pane into the inside of the insulating glass pane. Such a thermoplastic sealing mass is also called as primary sealing compound. It is preferably applied after indenting, but before bending the hollow profile bar, and more precisely substantially over the whole length of the hollow profile bar, including the indentions in the flanks of the hollow profile bar. This has the advantage that the sealing mass, when bending the respective corner, is carried away from the inwardly folding section of the flank and tightly pressed in the fold, so as to ensure that no cavity that is not filled with the sealing mass appears in the fold. The bending causes an excess of sealing mass in the corner area of the spacer, which causes additional strengthening of the sealing effect precisely in the critical region of the corner, which is particularly advantageous.

When it has been said here that the adhesive sealing mass should be applied substantially over the whole length of the hollow profile bar, what is meant is that at first a small length on the ends of the hollow profile bar of the hollow profile bar can remain free from sealing mass. Once both ends of the hollow profile bar have been connected by a straight male connector, a gap in the strand of the sealing mass can, if required, be closed by a later application of sealing mass.

If the longitudinal seam of a hollow profile bar made by roll forming lies on a flank of the hollow profile bar then the sealing mass covers the longitudinal seam and seals hermetically any poorly sealed points of the longitudinal seam. The longitudinal seam therefore lies preferably on a flank of the hollow profile bar.

The outer wall and the inner wall of the hollow profile bar and a compound containing a desiccant and applied to the spacer each inhibit the penetration of water vapour into the insulating glass pane. In the gap between the glass plates and the flanks of the spacer, the sealing mass applied there, for example a compound on the base of polyisobutylene, also prevents the penetration of humidity by a relatively long diffusion path. If some humidity should nevertheless diffuse through the adhesive sealing mass it can still be absorbed by the desiccant, which is embedded in a compound sticking to the hollow profile bar, which adjoins the sealing mass, which has been applied to the flanks. For example, a compound containing a desiccant known as TPS material in the production of insulating glass panes can be used. Such material is used in prior art for spacers that are extruded in situ onto a glass plate. Insulating glass panes fitted with such a thermoplastic spacer, in which a powder desiccant is embedded, are known under the trademark TPS. The TPS material is a primary sealing compound on the base of polyisobutylene with zeolite powder (molecular sieves) as a desiccant which is thinly distributed therein.

The sealing mass applied to the flanks and the mass containing a desiccant applied to the hollow profile bar may be different from one another, but they can also be identical. They are preferably applied in a common process synchronously or with a time overlap to both flanks and to the inner wall of the hollow profile bar. If a thermoplastic "primary" sealing compound is used for sealing the gaps between the spacer and both adjoining glass panes, the thermoplastic property compound form providing the strong bond needed between the glass plates and the spacer. Rather, a setting "secondary" sealing compound is required, for example a polysulfide (Thiokol), polyurethane or silicone in addition to the thermoplastic "primary" sealing compound. In prior art the secondary sealing compound is usually filled into a seam of the insulating glass pane, said seam being delineated by both glass plates and the outer wall of the spacer, which wall is recessed with respect to the edges of the glass plates.

It is particularly advantageous to apply the mass containing a desiccant only to the flanks of the spacer profile and to leave the cavity of the hollow profile bar empty. The invention hence does not require a perforated wall of the hollow profile bar. Rather, according to the invention, an economically available hollow profile bar can be used. This bar can even be simplified with respect to prior art inasmuch as none of the walls connecting the flanks is perforated, which at the same time improves the sealing of the insulating glass pane.

When using the spacer profile according to the invention, it is particularly advantageous to concentrate the desiccant containing mass in the narrower region of the spacer profile adjoining the inner wall, on the flanks thereof and to provide in the subsequent wider region of the spacer profile an adhesive sealing mass, which does not contain any desiccant, in particular a primary sealing compound and/or a setting secondary sealing compound, which directly connects to the adhesive compound incorporating the desiccant. The narrower region of the hollow profile bar adjoining the outer wall of the hollow profile bar contains advantageously a secondary sealing compound, which produces the durable bond between the glass plates and the spacer. The mass containing the desiccant and the adhesive sealing mass free of desiccant, also the secondary sealing compound, are preferably applied in a common process step to the flanks of the hollow profile bar. The mass, which contains the desiccant, can be the same mass, which is used as the primary sealing compound. It is also possible to use the mass containing a desiccant as the primary sealing compound, if it is sufficiently diffusion-tight as is the case with the TPS material on the base of polyisobutylene. Finally, a sealing compound according to the WO 2008/005214 A1 may be provided exclusively for the flanks. Such a sealing compound combines in itself the function of a primary as well as of a secondary sealing compound and additionally contains a desiccant. In this manner, one can succeed with a minimum amount of sealing compound and with minimum mechanical means implemented. Surprisingly it has been found that also such a small amount of sealing compound between the flanks of the spacer and the glass panes, also still contains a powder desiccant, enables to achieve good sealing of the insulating glass pane and perfect cohesion of the insulating glass pane.

Preferably, any sealing compound is applied only to the flanks of the hollow profile bar, that is to say the mass incorporating the desiccant, the primary sealing compound, if it is different from the mass containing the desiccant, and the secondary sealing compound, which sets and produces the durable bond between the glass panes and the spacer. This enables to produce insulating glass panes which not only have an appealing look, but also with a minimum use of expensive sealing compounds. Preferably, a thermoplastic sealing compound incorporating the desiccant, which at the same time fulfils the task of a primary sealing compound, is applied to the flanks and immediately after a setting sealing compound is applied to said flanks, a compound which fulfils the task of a secondary sealing compound.

The recessed partial regions of the flanks adjoining the middle partial regions of the flanks can be designed as steps with sharp edges, but are preferably concave in their cross-section, with a preferably rounded contour, which favours complete filling of the interspaces between the flanks of the spacer and the adjoining glass panes with sealing compound.

In their cross-section, the recessed partial regions adjoining on the respective middle partial regions of the flanks have preferably such a contour that the spacer profile tapers starting from the middle region towards the outer wall of the spacer profile and towards the inner wall of the spacer profile or tapers initially and then transitions into a region of reduced constant width, in which the flanks extend parallel to the middle partial regions of the flanks. Let us bear in mind that by the inner wall of the spacer is meant the wall of the spacer facing the inner space of the insulating glass pane and by the outer wall is meant the wall of the spacer opposite the inner wall. The recessed partial regions adjoining thereto are seen as belonging to the flanks.

It is also possible to select to the contour of the recessed partial regions of the flanks adjoining on the middle partial regions of the flanks in such a way that the spacer profile initially tapers starting from the middle partial region and then widens again when approaching the outer wall and/or the inner wall of the spacer profile so that an undercut is produced. Such a configuration is however not preferred because it may compromise the sealing of the insulating glass pane.

Preferably, a hollow profile bar is used which is designed asymmetrically as regards its longitudinal centre plane intersecting the flanks so that the recesses adjoining the inner wall are different from the recesses which adjoin the outer wall, and can absorb different amounts of sealing compound. This has the advantage that a spacer with one and the same hollow profile bar may be produced, in which the larger recesses are arranged adjoining the inner wall or the outer wall of the spacer. The insulating glass manufacturer may select that form of embodiment, which seems to him the most suitable for a given order. If mainly a large volume of mass containing a desiccant is wanted, he will orient the spacer profile in the spacer in such a way that the larger interspaces between the glass plates and the flanks are facing the inner space of the insulating glass pane. If on the other hand mainly a larger volume of secondary sealing compound is wanted, he will orient the spacer profile in such a way that the larger interspaces between the glass plates and the flanks of the spacer are facing outwardly.

As regards its longitudinal centre plane intersecting the outer wall and the inner wall, the hollow profile bar, which is used for the production of the spacer, is formed advantageously mirror-symmetrically.

For producing a spacer for insulating glass panes, the straight hollow profile bar is preferably indented at all locations at which a corner should be formed. The adhesive sealing mass is then applied to both flanks of the hollow profile bar. If the adhesive sealing mass, which is applied to the flanks, does not contain a desiccant, a mass containing a desiccant is additionally applied to the flanks of the hollow profile bar. Preferably, this is done in a single process step by coextrusion or with a time overlap; the mass containing a desiccant preferably connects directly and without gaps to the adhesive sealing mass which does not include any desiccant. The corners are then bent, which can be done by a machine, but is also possible manually with minimal means implemented, since the position and the form of the corners are already predetermined by the previous indenting of the hollow profile bar. The bending is particularly easy, if there is adhesive neither on the inner wall nor on the outer wall of the hollow profile bar, but rather solely on the flanks. The hollow profile bar can then be seized on its inner wall and on its outer wall without any problems, without touching the mass applied to the flanks, and can then be bent manually or by a machine. Such procedure enables to dispense with several machines which used to be necessary for the production of spacer frames for insulating glass panes, that is to say a machine for filling hollow profile bars with a desiccant, a machine for bending filled hollow profile bars, and a machine for coating an already completely bent spacer frame, for which purpose it would have to be rotated repeatedly and passed between a pair of nozzles, see for instance DE 34 34 545 C1. The coating of a straight hollow profile bar before bending to form a spacer frame is substantially easier than the coating of a frame made of the hollow profile bar. The invention therefore enables an extraordinarily rational production of coated spacer frames. Preferably, a secondary sealing compound is applied to the flanks of the hollow profile bar, before the frame is bent, or a uniform sealing compound is applied, which fulfils the task of the primary and secondary sealing compound and preferably also contains the desiccant. Then, even the sealing machine intended for the secondary sealing compound can be dispensed with, which is the most expensive machine in an insulating glass production line according to prior art (see for instance DE 28 16 437 A1).

To finish, both ends of the hollow profile bar are connected to one another by a straight male connector, which is inserted into both ends of the hollow profile bar. When feeding the hollow profile bar to the tools, with which it is indented, the male connector can already be inserted in an end of the hollow profile bar, so that after bending the hollow profile bar, only the other end of the male connector must still be inserted into the hollow profile bar.

For an easier bending process, the profile bars preferably have grooves or ripples extending at least on their inner wall at right angle with respect to the glass panes. Such grooves or ripples are preferably also provided on the outer wall of the hollow profile bars. Each particular groove respectively ripple defines a possible bending point and facilitates, when it is provided on the outer wall, the expansion of the outer wall during bending. The grooves or ripples end preferably at a distance from the flanks, to avoid undesirable, outwardly directed warps of the flanks.

If hollow profile bars according to the invention are used for the production of spacers for insulating glass panes, wherein the inner wall and the also outer wall are narrower than the hollow profile bar as a whole, so that the flanks are recessed on both sides of their flat, middle partial region, the occurrence of cracks in the sealing compound as an effect of alternating pressure, temperature and wind loads can be prevented even with a very thin film of the sealing compound in the gap between the flat middle partial regions of the flanks and the adjoining glass plates, that is to say with a thickness of the sealing compound of only 0.25 mm to 0.45 mm, preferably of only 0.3 mm to 0.4 mm. To produce such a thin film of the sealing compound, there is no need to press in the insulating glass pane in a controlled manner to obtain a preset thickness, it is sufficient to act upon the insulating glass pane with a preset specific pressure of for instance 40 Newton per running centimeter of the circumference of the spacer.

An object of the present invention is ultimately a hollow profile bar formed according to the invention for the production of a frame-shaped spacer for insulating glass panes.

In summary, the invention offers a large number of advantages:

- Hollow spacer frames can be used, which are sealed hermetically and contain no desiccant. Such spacer frames stand out thanks to a particularly low heat transfer coefficient, especially if they consist of stainless steel. Stainless steel means long service life, is insensitive to UV-light, has a minimal thermal expansion and a minimal thermal conductivity, absorbs no humidity and is diffusion-tight.
- The hollow and hermetically sealed spacer, whose cavity acts as a very good insulator, offers a double barrier with respect to the penetration of water vapour.
- The outer wall of the spacer can remain free of sealing compound, so that the only bridge between two glass plates of an insulating glass pane is the hollow and empty spacer itself. This lowers the heat transfer between both glass plates of an insulating glass pane and reduces the risk of condensate formation in the edge region of the insulating glass pane. At the same time, a more uniform surface temperature of the insulating glass pane can be obtained.
- If sealing compound is only provided in the joints between the spacer and the adjoining glass plates the result is quite satisfactory without losing on the sealing efficiency and on the service life of the insulating glass pane even with minimal amounts of sealing compound. The necessary amount of sealing compounds is independent of the width of the spacer.
- The outer wall of the spacer can be flush with the edges of the glass plates, which enables to increase the clear cross-section of the insulating glass pane and to reduce the required installation depth in a window frame or a door frame.
- The outer wall of the spacer can be varnished for aesthetic reasons or to protect it.
- Especially if a spacer profile is used in which the outer wall as well as the inner wall are narrower than the hollow profile bar as a whole, the insulating glass pane can be pressed with a predetermined pressing power per running centimeter of the circumference of the spacer, namely in such a way that the sealing compound at the thinnest point is then only about 0.3 mm to 0.4 mm thick, which not only saves on sealing compound, but rather increases at the same time the resistance against the penetration of water vapour. Stress loads in the sealing compound can be mastered in such a way that the thickness, in which the sealing compound is provided on the flanks of the spacer, is left to increase towards the inner wall and to the outer wall of the spacer.

BRIEF DESCRIPTION OF THE DRAWING

Examples of embodiments of the invention are represented in the accompanying drawings and are described below. Identical and correlating parts are designated with matching reference numbers in the different embodiments.

DETAILED DESCRIPTION

Figure 1:
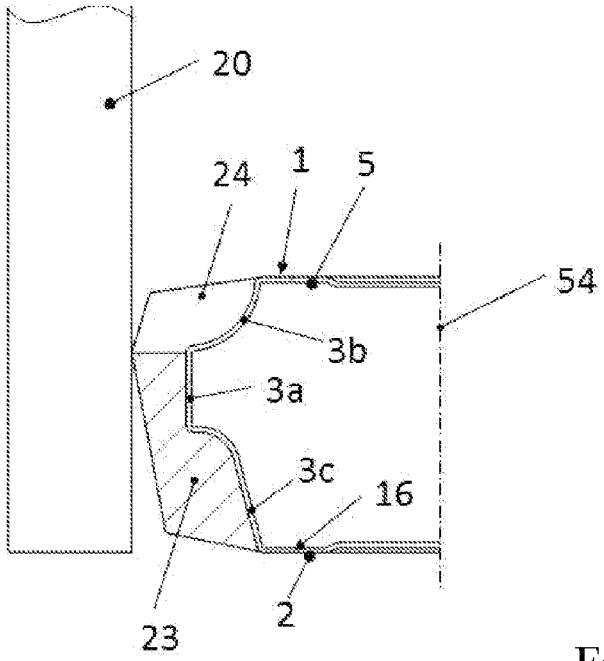
FIG. 1 shows a cross section through half a spacer with a profile shape according to the invention in addition to a glass plate, before pressing the insulating glass pane.
Figure 2:
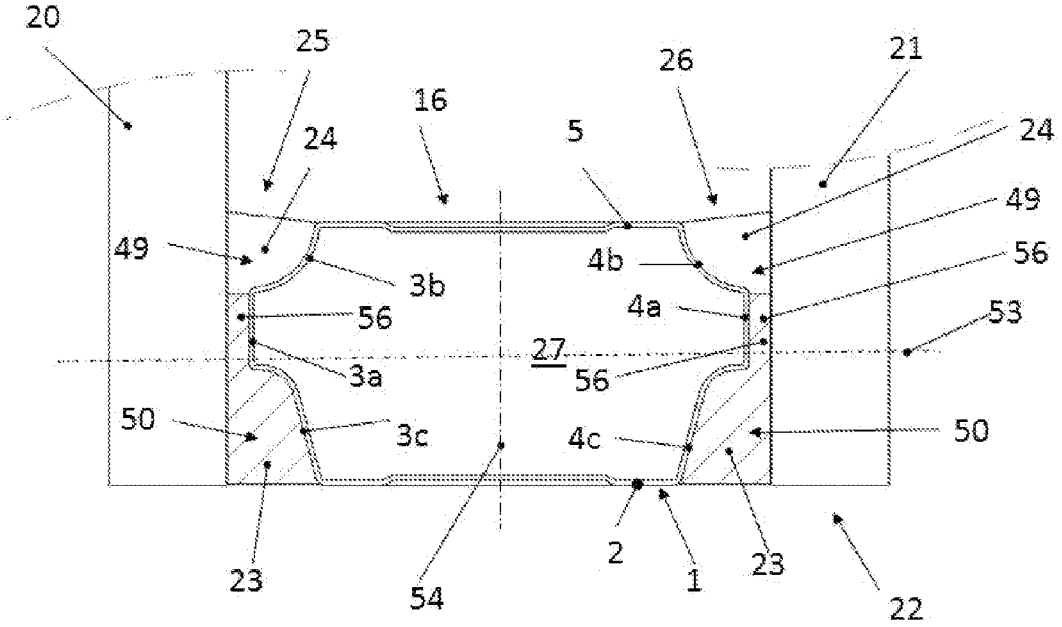
FIG. 2 shows a cross section through a portion of a pressed insulating glass pane with a spacer with the profile shape of FIG. 1.
Figure 3:
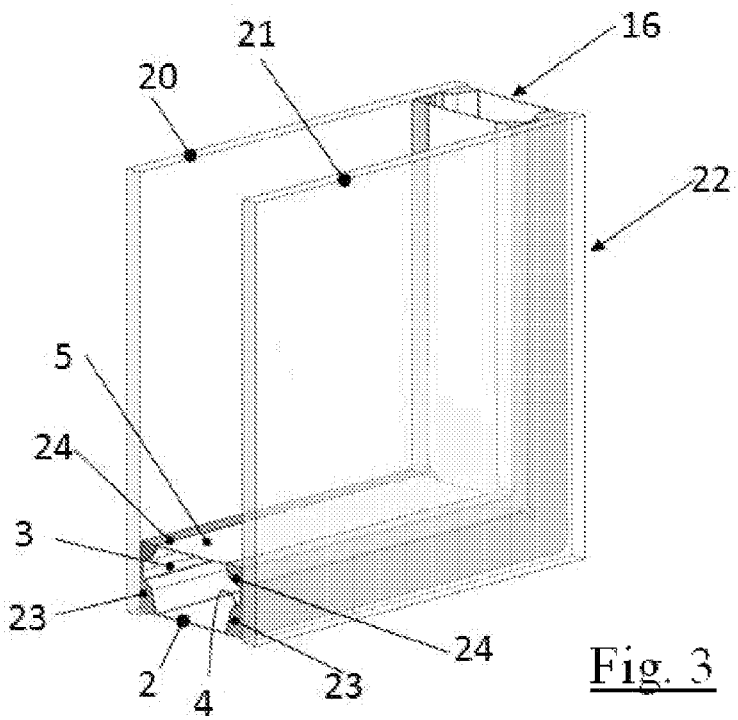
FIG. 3 shows a cut-out of the insulating glass pane according to FIG. 2 in an oblique view.
Figure 4:
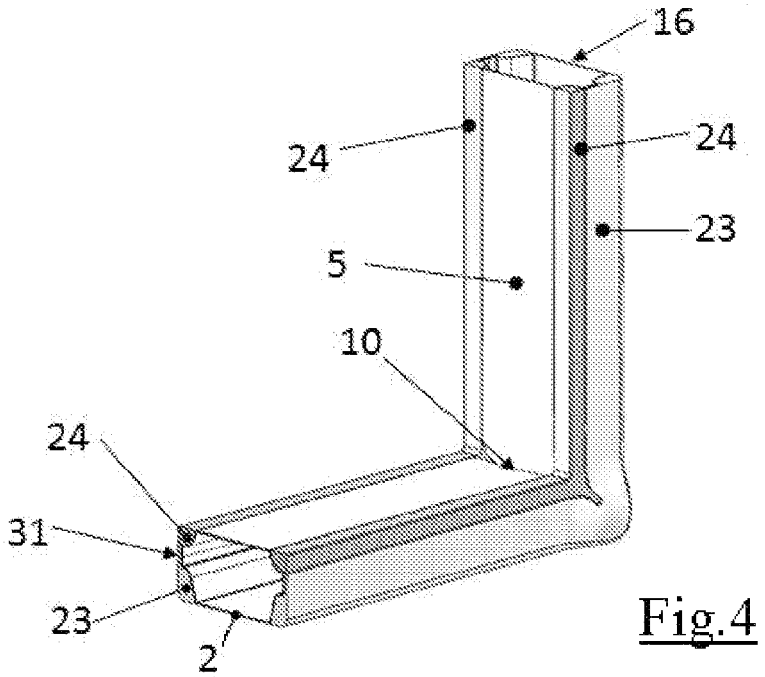
FIG. 4 shows the spacer of the pressed insulating glass pane according to FIG. 3 in an oblique view as in FIG. 3, with the glass plates not shown.

FIGS. 1 to 5 show a spacer 16 for insulating glass panes. The spacer is made of a metallic hollow profile bar 1. The hollow profile bar 1 has an outer wall 2, two flanks 3 and 4, which are parallel to one another, and an inner wall 5 parallel to the outer wall 2. Said flanks run parallel to one another and at right angle with respect to the outer wall 2 and with respect to the inner wall 5 in a middle flat partial region 3*a*, 4*a* of the flanks 3 and 4. In a concave partial region 3*b*, 4*b* of the flanks 3 and 4 which is adjoining the inner wall 5, and in a concave partial region 3*c* and 4*c* of the flanks which is adjoining the outer wall 2, the hollow profile bar 1 is narrower than in the middle, flat partial regions 3*a* and 4*a*.

The inner space 27 of the spacer 16 is empty. It only contains air, but no desiccant. All its walls 2, 3, 4 and 5 are airtight.

Interspaces 49 and 50 are formed by the concave partial regions 3*b* respectively 4*b* and 3*c* respectively 4*c* between the spacer 16 and the glass plates 20 and 21 in the insulating glass pane 22, which interspaces extend from the gaps 56 between the glass plates 20 and 21 and the respective opposite middle partial regions 3*a* and 4*a* up to the inner wall 5 respectively up to the base 2. The interspaces 50, which adjoin the base 2, and the gaps 56 absorb sealing compound, preferably a setting secondary sealing compound 23. The interspaces 49, which are provided adjoining the inner wall 2 absorb a primary sealing compound 24, which contains a desiccant.

Such a spacer profile has two significant advantages: On the one hand, glass plates 20 and 21 can bend farther to fluctuations of the external air pressure, under wind load and under the action of heat, without thin cracks, which might cause a poor seal, occurring in the secondary sealing compound 23 and in particular in the primary sealing compound 24. On the other hand, such a spacer profile, if the interspaces 49 have another size than the interspaces 50, can be at choice machined to form a spacer 16 and be incorporated in an insulating glass pane 22 in such a way that the larger interspace 50 is outside (see FIG. 2), if more secondary sealing compound 23 than primary sealing compound 24 with embedded desiccant is desirable in the joints 25 and 26, or is inside (see FIG. 13), if more primary sealing compound 24 with embedded desiccant than secondary sealing compound 23 is desirable in the joints 25 and 26.

Figure 5:
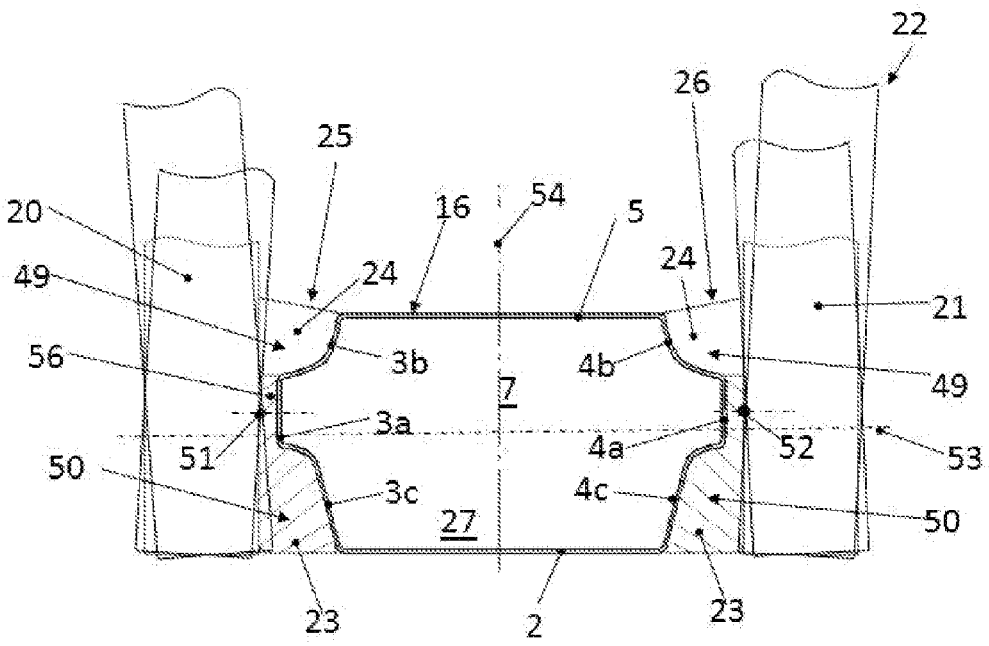
FIG. 5 shows schematically in a cross section through a portion of an insulating glass pane as in FIG. 2, how the insulating glass pane behaves with alternating bendings of their glass plates.

FIG. 5 illustrates the behaviour of an insulating glass pane 22 with such a spacer 16, when the glass plates 20 and 21 of the insulating glass pane 22 are subjected to bending stress. The glass plates 20 and 21 are represented with thick strokes in a state in which they are not subjected to bending stress. The same glass plates are represented with thin strokes when they are subjected to bending stress in one or the other direction. As regards the spacer 16, they behave when subjected to bending stress as if a virtual joint or a virtual pivot axis 51 respectively 52 would be situated at the height of the flat partial regions 3*a* and 4*a* of the flanks 3 and 4, which joint extends in longitudinal direction of the flank 3 respectively 4. The magnitude of the movement of the glass plates 20, 21 is the smallest close to the virtual pivot axis 51, 52 so that the movement of the glass plates 20 and 21 does not cause the primary sealing compound 24 and the secondary sealing compound 23 to tear, even with a thin film of the secondary sealing compound 23 in the gap between the glass plates 20 and 21 on the one side and on the flat partial regions 3*a* and 4*a* of the flanks on the other side. The magnitude of the movements of the glass plates 20 and 21 is larger further away from the virtual pivot axis 51, 52, at the height of the inner wall 5 of the spacer 16 and at the height of the base 2 of the spacer 16, but the forces pulling there at the secondary sealing compound 23 and at the primary sealing compound 24 with embedded desiccant are distributed over a substantially larger width of the joints 24, 25 and 26, so that it does not cause the formation of cracks in the primary sealing compound 24 with embedded desiccant respectively in the secondary sealing compound 23.

In the example of FIGS. 1 to 5, the interspaces 50 adjacent to the base 2 are greater than the interspaces 49 adjacent to the inner wall 5 of the spacer 16. Consequently, the spacer profile in the embodiment of FIGS. 1 to 5 are asymmetrical as regards a longitudinal centre plane 53 through the hollow profile bar 1, which extends at right angle to the flat intermediate regions 3*a* and 4*a* of the flanks. The hollow profile bars 1 are however mirror-symmetrical with respect to the other longitudinal centre plane 54, running parallel to the flat intermediate regions 3*a* and 4*a* of the flanks.

Figure 13:
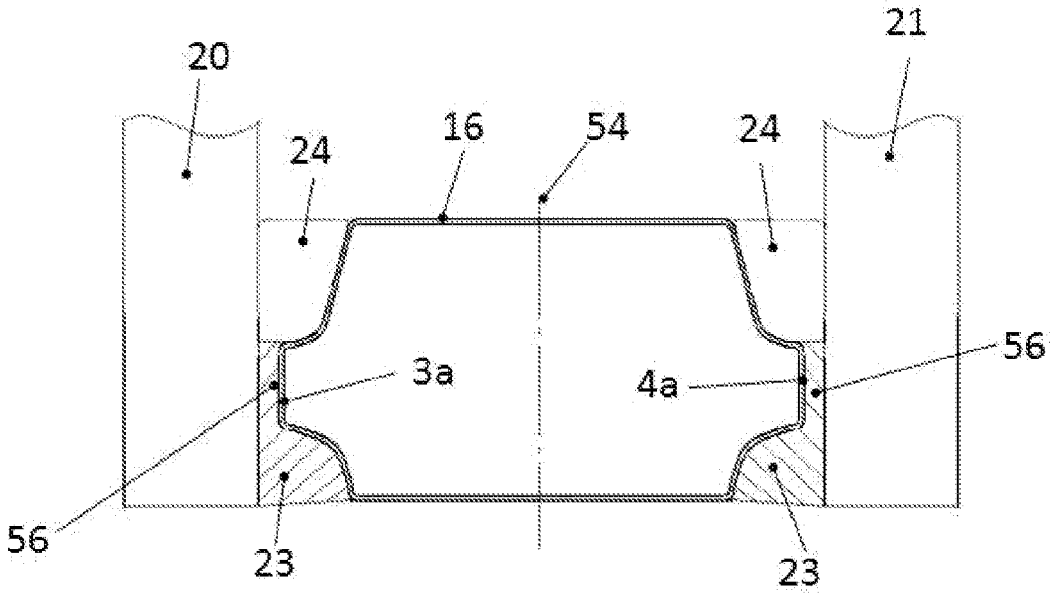

FIG. 13 shows that hollow profile bars 1 with the profile shape shown in FIGS. 1 to 5 can also be formed with a reverse orientation to a spacer 16 and incorporated in an insulating glass pane 15, i.e. that the wall, which forms the base 2 in FIGS. 1 to 5, forms the inner wall of the spacer 16 in FIG. 13, while the wall forming the inner wall 5 of the distance 16 in FIGS. 1 to 5, has become the base in FIG. 13.

Figure 6:
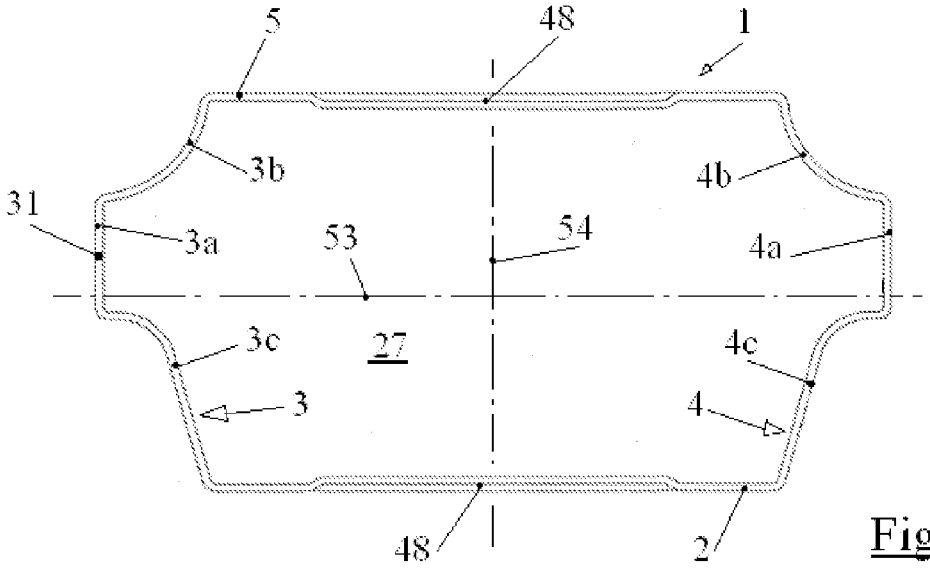
FIG. 6 shows a cross section through a spacer of the kind as illustrated in FIGS. 1 to 5, but with the base of the spacer profile and the upper side of the spacer profile opposite thereto being additionally provided with grooves.
Figure 7:
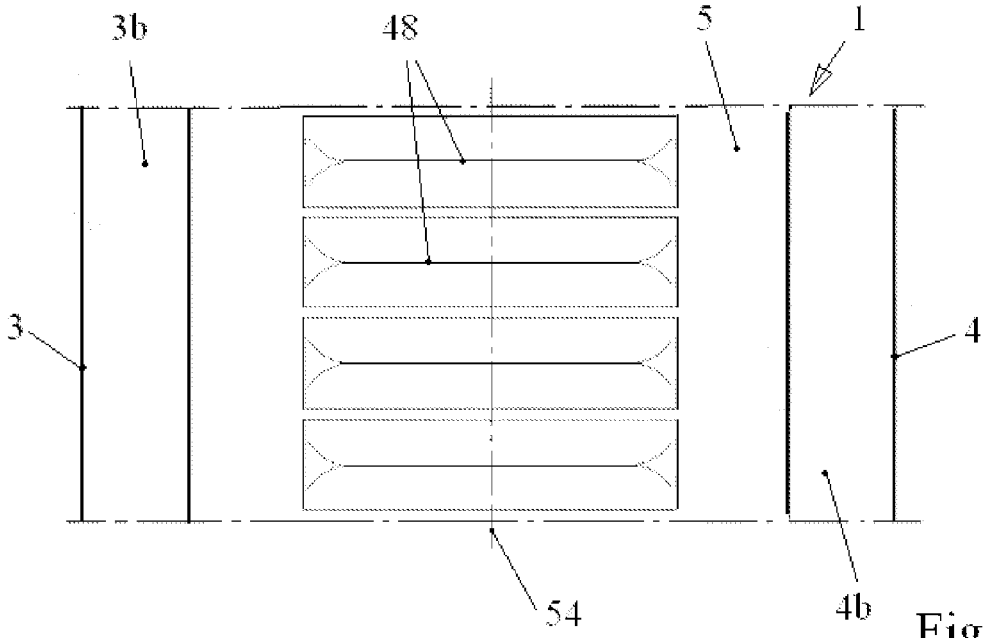
FIG. 7 shows a section of the spacer of FIG. 6 in an elevation view, the FIGS. 8 to 12 show representations, which correspond to the FIGS. 1 to 5, of an insulating glass pane with a spacer profile modified with respect to FIGS. 1 to 5, the FIG. 13 shows a cross section through a portion of an insulating glass pane with a spacer profile as in FIGS. 1 to 5, but in contrary thereto installed reversely, the FIG. 14 shows a cross section through a portion of an insulating glass pane with a spacer profile as in FIGS. 8 to 12, but in contrary thereto installed reversely, and the FIG. 15 shows in a side view a spacer frame produced according to the invention, incorporated in an insulating glass pane.
Figure 8:
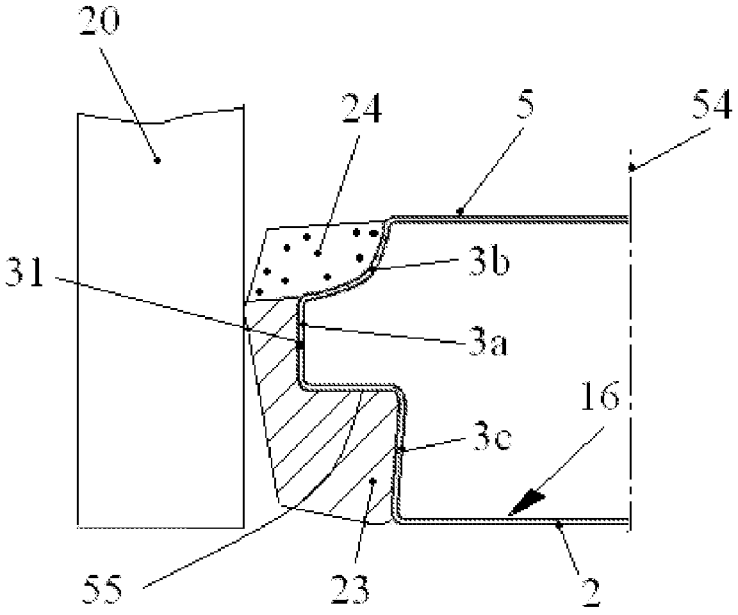
Figure 9:
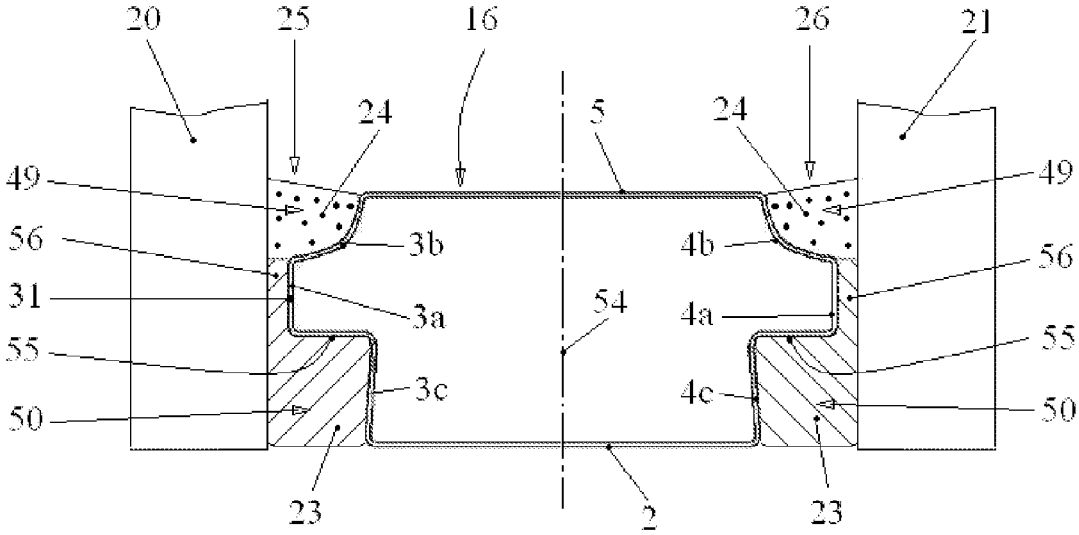
Figure 10:
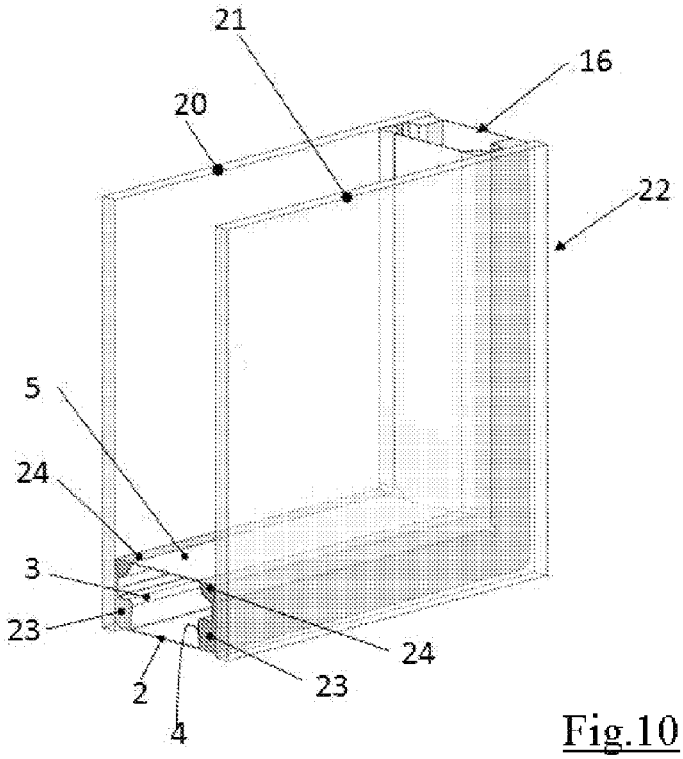
Figure 11:
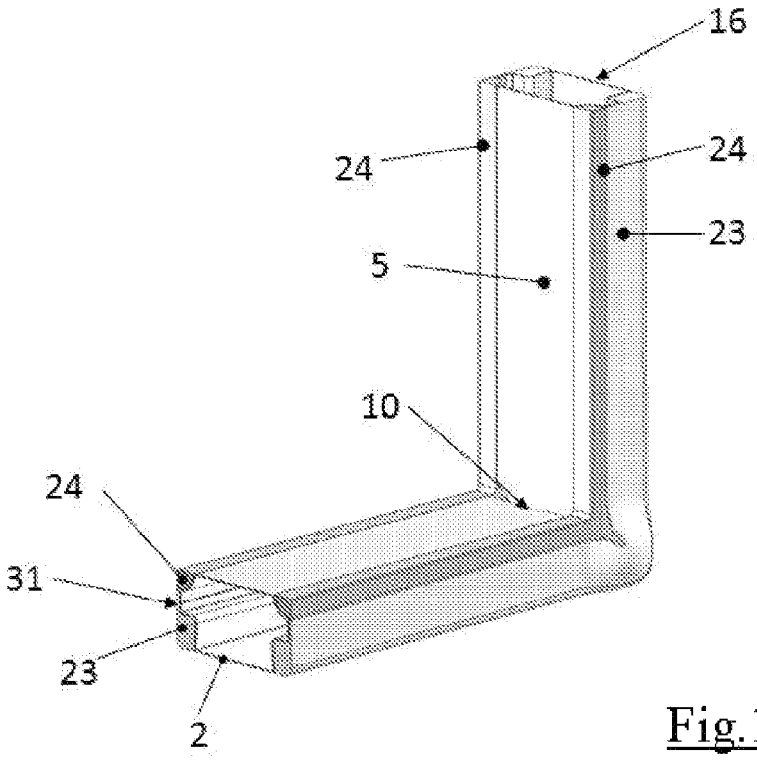
Figure 12:
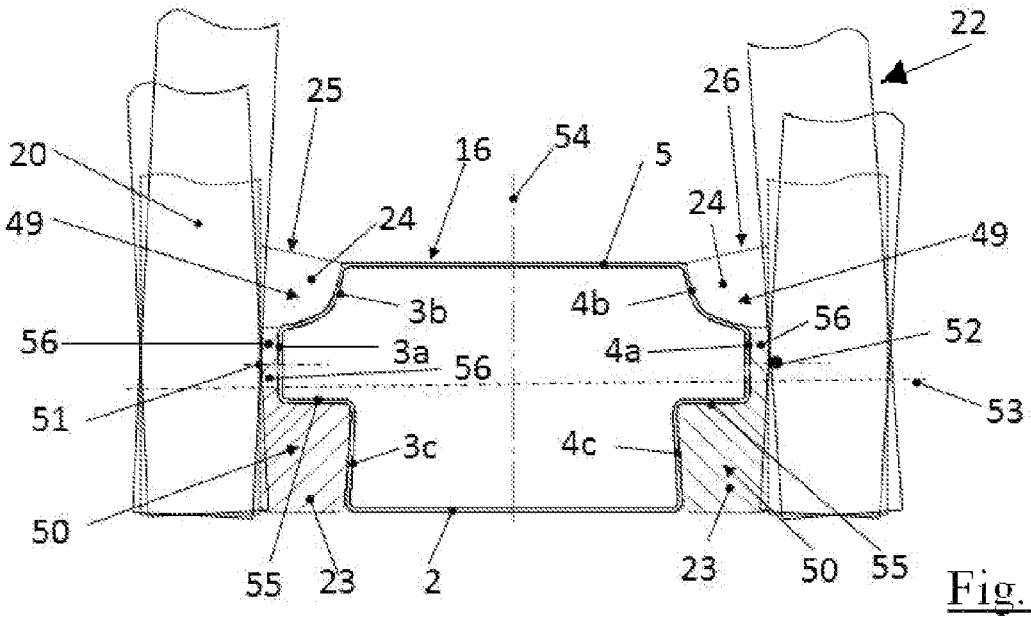

FIGS. 6 and 7 show a refinement of the spacer 16 shown in FIGS. 1 to 5. The variation consists in that the base 2 as well as the inner wall 5 are provided continuously with grooves 48, which extend at right angle to the flat intermediate regions 3*a* and 4*a* of the flanks, keep a distance from the flanks 3, 4, are all identical and equidistant to one another. These grooves 48 may be formed by embossing. They facilitate the bending or the folding of corners of the spacer 16. For this advantage, it is preferred to provide the grooves 48. They are well suited for all embodiments of the present invention.

The embodiment illustrated in FIGS. 8 to 12 differs from the embodiment illustrated in FIGS. 1 to 5 only in the form of the interspaces 50, which adjoin the base 2 of the spacer 16. While in the example of FIGS. 1 to 5 the interspaces 50 steadily increase starting from the flat intermediate regions 3*a* and 4*a* up to the base 2, they increase steadily in the embodiment of FIGS. 8 to 12 starting from the base 2 up to the flat intermediate areas 3*a* and 4*a*, which causes an undercut seen from the base 2. This undercut ends at a wall 55 parallel to the base 2. This wall delineates the flat intermediate region 3*a* respectively 4*a* in the outward direction, i.e. in direction of the base 2.

As regards the bending movements of the glass panes 20 and 21, the insulating glass pane represented in FIGS. 8 to 12 behaves similarly to the insulating glass pane represented in FIGS. 1 to 5.

Figure 14:
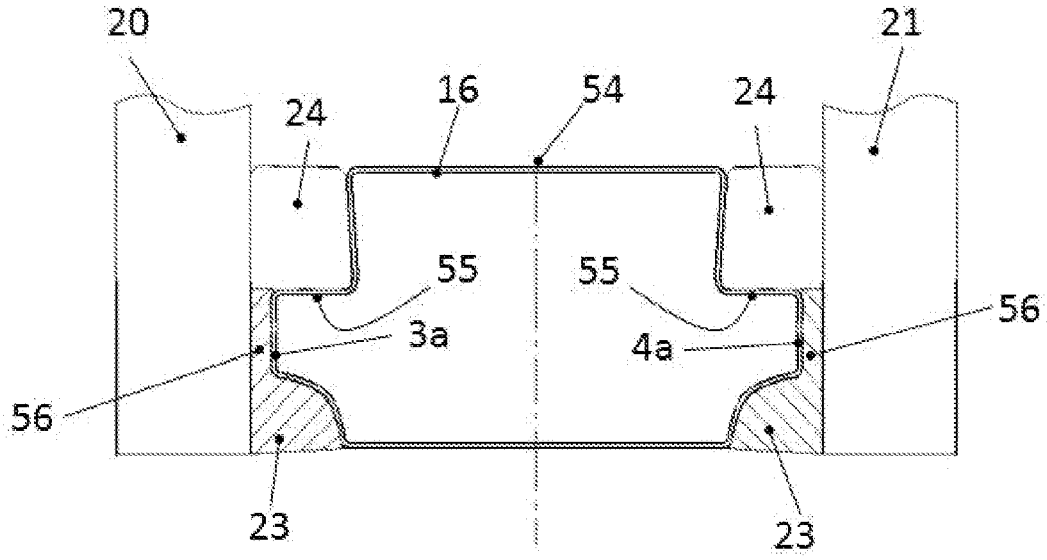

FIG. 14 shows that the profile shape used in the embodiment of FIGS. 8 to 12 can be worked in reverse orientation to form a frame-shaped spacer and inserted into an insulating glass pane.

When all the corners of the spacer 16 have been bent, both ends of the hollow profile bar 1 lie opposite one another and must be connected to one another, in order to close the spacer 16. This connection point should not lie on a corner of the spacer 16, but rather between two corners, so that both ends of the hollow profile bar I are flush-mounted with one another in the spacer 16. A linear connector 17 is inserted into both ends of the hollow profile bar 1 for connecting both ends of the hollow profile bar 1.

Figure 15:
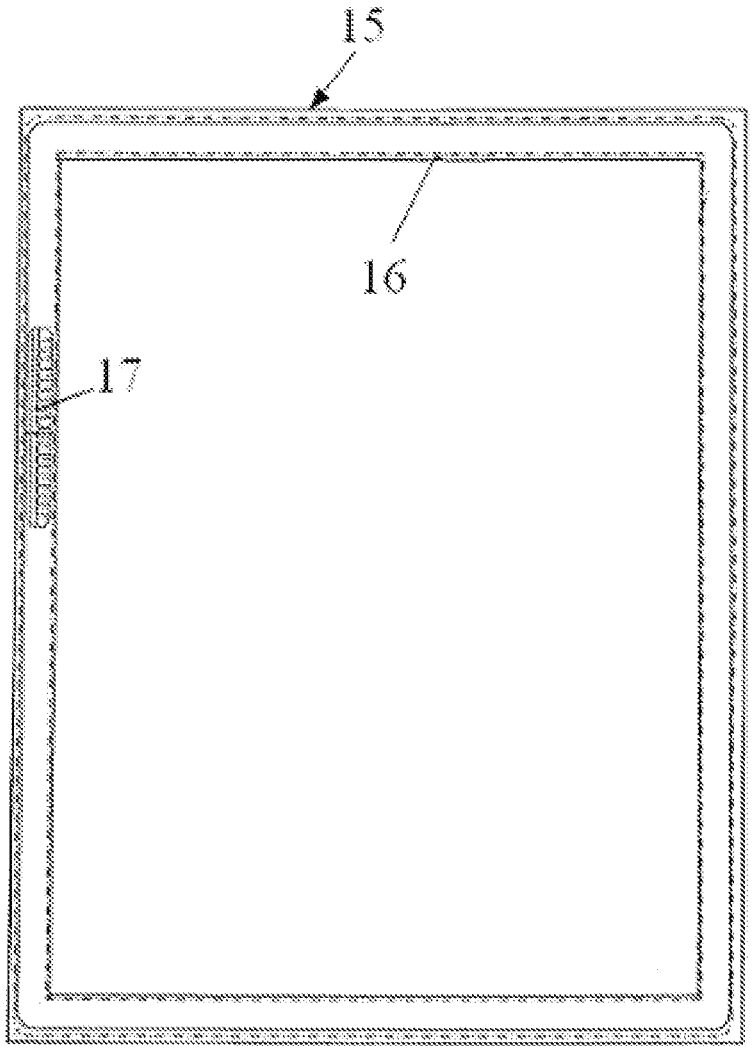

An example for this is shown in FIG. 15.

LIST OF REFERENCE NUMBERS:

1. Hollow profile bar
2. Outer wall, base
3. Flank
3*a/b/c*. Partial regions of the flanks
4. Flank
4*a/b/c*. Partial regions of the flanks
5. Inner wall
10. Narrow gap
15. Insulating glass pane
16. Spacer
17. Male connector
20. Glass plate
21. Glass plate
22. Insulating glass pane
23. Secondary sealing compound
24. Mass containing a desiccant, primary sealing compound
25. Joint
26. Joint
27. Inner space of 16
31. Longitudinal seam
48.
49. Interspace
50. Additional interspace
51. Virtual joint, virtual pivot axis
52. Virtual joint, virtual pivot axis
53. Longitudinal centre plane

54. Longitudinal centre plane
55. Wall
56. gap

The invention claimed is:

1. A method for the production of a frame-shaped spacer for insulating glass panes which comprise two individual glass plates spaced by adhering the spacer to the two individual glass plates, comprising the steps of:

selecting a hollow profile bar, which comprises an outer wall, an inner wall opposite the outer wall and two oppositely disposed flanks connecting the inner and outer walls, the flanks each comprising a middle flat partial region disposed substantially parallel to the two individual glass plates including an inner side recessed partial region between the middle flat partial region and the inner wall and an outer side recessed partial region between the middle flat partial region and the outer wall, where the length of the inner wall and the outer wall are narrower than the distance between the middle flat partial regions of the flanks and wherein the hollow profile bar is airtight or gastight and also empty wherein the hollow profile bar does not contain a desiccant; and forming the frame-shaped spacer by bending the hollow profile bar at least two times.

2. The method according to claim 1, wherein the hollow profile bar is designed asymmetrically in regards to its longitudinal center plane intersecting the flanks.

3. The method according to claim 2, wherein a cross section of the recessed partial regions of the hollow profile bar on one side of the longitudinal center plane intersecting the flanks is smaller than the cross section of the recessed partial regions on the other side of this longitudinal center plane.

4. The method according to claim 1, wherein the hollow profile bar is designed mirror-symmetrically to its longitudinal center plane intersecting the outer wall and the inner wall.

5. The method according to claim 1, wherein the hollow profile bar is formed from a metal band, whose longitudinal edges meet on a flank of the hollow profile bar and are there connected to one another by welding or bonding.

6. The method according to claim 1, wherein none of the walls of the hollow profile bar comprises an opening.

7. The method according to claim 1, wherein the hollow profile bar comprises aluminum, aluminum alloy or of a non-corrosive steel.

8. The method according to claim 1, wherein the inner side recessed partial region adjoining the inner wall of the hollow profile bar is narrower than the outer side recessed partial region adjoining the outer wall of the hollow profile bar.

9. The method according to claim 1, wherein the inner wall of the hollow profile bar comprises grooves which have an orientation at right angle to its flanks.

10. The method according to claim 9, wherein the grooves end at a distance before the flanks.

11. The method according to claim 1, wherein the frame-shaped spacer is produced by bending the hollow profile bar to form corners of the spacer.

12. The method according to claim 1, wherein the spacer is formed from the hollow profile bar in which the recessed partial regions of the flanks adjoining the respective middle flat partial regions of the flanks have such a contour that the spacer profile tapers from the middle flat partial regions of the flanks towards the outer wall and towards the inner wall of the spacer profile or first of all tapers and then passes over into a region of a reduced constant width.

13. The method according to claim 1, wherein the inner wall and the outer wall of the hollow profile bar are provided with grooves which have an orientation at right angle to its flanks.

14. The method according to claim 13, wherein the grooves are so provided in the inner wall and in the outer wall of the hollow profile bar that they end at a distance before the flanks.

15. The method according to claim 1, including the step of placing a sealant along each of the flanks including the middle flat partial region, the inner side recessed partial region and the outer side partial recessed partial region.

16. The method according to claim 15, wherein the step of placing the sealant is before the step of forming the frame-shaped spacer by bending the hollow profile bar.

17. The method according to claim 1, wherein a first end and a second end of the frame-shaped spacer meet after bending the hollow profile bar creating a complete perimeter extending around all the sides of the two individual glass plates.

18. A method for the production of a frame-shaped spacer for insulating glass panes which comprise two individual glass plates spaced by adhering the spacer to the two individual glass plates, comprising the steps of:

selecting a hollow profile bar, which comprises an outer wall, an inner wall opposite the outer wall and two oppositely disposed flanks connecting the inner and outer walls, the flanks each comprising a middle flat partial region disposed substantially parallel to the two individual glass plates including an inner side recessed partial region between the middle flat partial region and the inner wall and an outer side recessed partial region between the middle flat partial region and the outer wall, where the length of the inner wall and the outer wall are narrower than the distance between the middle flat partial regions of the flanks, and wherein the hollow profile bar is airtight or gastight;

forming the frame-shaped spacer by bending the hollow profile bar; and placing a sealant along each of the flanks including the middle flat partial region, the inner side recessed partial region and the outer side partial recessed partial region.

19. The method according to claim 18, wherein a first end and a second end of the frame-shaped spacer meet after bending the hollow profile bar creating a complete perimeter extending around all the sides of the two individual glass plates.

20. A method for the production of a frame-shaped spacer for insulating glass panes which comprise two individual glass plates spaced by adhering the spacer to the two individual glass plates, comprising the steps of:

selecting a hollow profile bar, which comprises an outer wall, an inner wall opposite the outer wall and two oppositely disposed flanks connecting the inner and outer walls, the flanks each comprising a middle flat partial region disposed substantially parallel to the two individual glass plates including an inner side recessed partial region between the middle flat partial region and the inner wall and an outer side recessed partial region between the middle flat partial region and the outer wall, where the length of the inner wall and the outer wall are narrower than the distance between the middle flat partial regions of the flanks, and wherein the hollow profile bar is airtight or gastight;

placing a sealant along each of the flanks including the middle flat partial region, the inner side recessed partial region and the outer side partial recessed partial region; and forming the frame-shaped spacer by bending the hollow profile bar, wherein the step of placing the sealant is before the step of forming the frame-shaped spacer by bending the hollow profile bar.

* * * * *